US009834359B2

(12) United States Patent
Bates et al.

(10) Patent No.: US 9,834,359 B2
(45) Date of Patent: Dec. 5, 2017

(54) VACUUM BASE FOR CONTAINER

(71) Applicant: Amcor Limited, Hawthorn, Victoria (AU)

(72) Inventors: Peter A. Bates, Sylvania, OH (US); Richard J. Steih, Jackson, MI (US)

(73) Assignee: Amcor Limited, Hawthorn, Victoria (AU)

( * ) Notice: Subject to any disclaimer, the term of this patent is extended or adjusted under 35 U.S.C. 154(b) by 0 days.

(21) Appl. No.: 15/120,199

(22) PCT Filed: Feb. 20, 2014

(86) PCT No.: PCT/US2014/017424
§ 371 (c)(1),
(2) Date: Aug. 19, 2016

(87) PCT Pub. No.: WO2015/126404
PCT Pub. Date: Aug. 27, 2015

(65) Prior Publication Data

US 2017/0057724 A1 Mar. 2, 2017

(51) Int. Cl.
*B65D 79/00* (2006.01)
*B65D 21/02* (2006.01)
(Continued)

(52) U.S. Cl.
CPC ..... *B65D 79/005* (2013.01); *B65D 1/0246* (2013.01); *B65D 1/0276* (2013.01); *B65D 21/0231* (2013.01); *B65D 51/245* (2013.01)

(58) Field of Classification Search
CPC .... B65D 79/005; B65D 79/00; B65D 1/0246; B65D 1/023; B65D 1/0276; B65D 1/0261;
(Continued)

(56) References Cited

U.S. PATENT DOCUMENTS 4,616,761 A * 10/1986 Nolan ..... B65D 41/0442 215/271
5,908,128 A * 6/1999 Krishnakumar ..... B65D 1/0223 215/381
(Continued)

FOREIGN PATENT DOCUMENTS

CO 6491100 A2 7/2012
EP 2205499 B1 6/2012
(Continued)

OTHER PUBLICATIONS

International Search Report and Written Opinion for PCT/US2014/017424, dated Nov. 27, 2014; ISA/KR.
(Continued)

*Primary Examiner* — Robert J Hicks
(74) *Attorney, Agent, or Firm* — Harness, Dickey & Pierce, P.L.C.

(57) ABSTRACT

A container including a finish, a shoulder portion, a sidewall, and a base portion. The finish defines an opening. The shoulder portion extends from the finish. The sidewall extends from the shoulder portion and defines a volume of the container. The base portion is at an end of the sidewall opposite to the shoulder portion. The base portion includes a primary standing ring and a secondary standing ring. The base portion is movable from an as-blown position to an expanded position and from the expanded position to a retracted position. In the as-blown and retracted positions the primary standing ring is configured to support the container upright. In the expanded position the secondary standing ring is configured to support the container upright.

34 Claims, 8 Drawing Sheets

(51) Int. Cl.
*B65D 1/02* (2006.01)
*B65D 51/24* (2006.01)

(58) Field of Classification Search
CPC ..... B65D 21/0231; B65D 21/023; B65D 21/0202; B65D 21/0201
USPC ..... 220/629, 628, 609, 608, 604, 600, 624, 220/623, 610; 215/373, 372, 371, 376, 215/900, 370; 206/507, 505, 504; 428/36.9; D9/548, 520, 516
See application file for complete search history.

(56) References Cited

U.S. PATENT DOCUMENTS 6,277,321 B1* 8/2001 Vailliencourt ..... B29C 49/18 264/529
8,152,010 B2 4/2012 Melrose
2003/0221987 A1* 12/2003 Trude ..... B65D 1/0276 206/508
2007/0199915 A1* 8/2007 Denner ..... B65D 79/005 215/375
2008/0047964 A1* 2/2008 Denner ..... B29C 49/06 220/624
2008/0298938 A1* 12/2008 Melrose ..... B65D 1/0276 414/293
2009/0090721 A1 4/2009 Buisson et al.
2009/0090728 A1* 4/2009 Trude ..... B65D 1/0276 220/609
2009/0202766 A1* 8/2009 Beuerle ..... B29C 49/4815 428/36.9
2010/0163513 A1 7/2010 Pedmo
2010/0219152 A1 9/2010 Derrien et al.
2011/0017700 A1 1/2011 Patcheak et al.
2013/0213980 A1* 8/2013 Pedmo ..... B65D 1/40 220/600
2013/0219831 A1 8/2013 Trude et al.
2013/0306588 A1 11/2013 Boukobza
2014/0048508 A1* 2/2014 Kamineni ..... B65D 1/0276 215/383
2014/0224813 A1* 8/2014 Bysick ..... B65D 1/0276 220/609

FOREIGN PATENT DOCUMENTS

JP 2011500459 A1 10/2003
JP 20060501109 A 1/2006
JP 2010275014 A 12/2010
JP 2011500459 A 1/2011
JP 2013144560 A 7/2013
JP 2013159380 A 8/2013
WO WO-03080460 A1 10/2003
WO WO-2013073261 A1 5/2013

OTHER PUBLICATIONS

Office Action dated Aug. 10, 2017 in corresponding Colombian Patent Application No. NC2016/0001450.
Office Action dated Sep. 12, 2017 in corresponding Japanese Patent Application No. 2016-553465.
Supplementary European Search Report dated Aug. 4, 2017 in corresponding European Patent Application No. 14883360.1.

* cited by examiner

VACUUM BASE FOR CONTAINER

CROSS REFERENCE TO RELATED APPLICATION

This application is a U.S. National Phase Application under 35 U.S.C. 371 of International Application No. PCT/US2014/017424 filed on Feb. 20, 2014 and published as WO 2015/126404 A1 on Aug. 27, 2015. The entire disclosure of the above application is incorporated herein by reference.

FIELD

The present disclosure relates to a vacuum base for a container.

BACKGROUND

This section provides background information related to the present disclosure, which is not necessarily prior art.

As a result of environmental and other concerns, plastic containers, more specifically polyester and even more specifically polyethylene terephthalate (PET) containers, are now being used more than ever to package numerous commodities previously packaged in glass containers. Manufacturers and fillers, as well as consumers, have recognized that PET containers are lightweight, inexpensive, recyclable and manufacturable in large quantities.

Manufacturers currently supply PET containers for various liquid commodities, such as juice and isotonic beverages. Suppliers often fill these liquid products into the containers while the liquid product is at an elevated temperature, typically between 68° C.-96° C. (155° F.-205° F.) and usually at approximately 85° C. (185° F.). When packaged in this manner, the hot temperature of the liquid commodity sterilizes the container at the time of filling. The bottling industry refers to this process as hot filling, and containers designed to withstand the process as hot-fill or heat-set containers.

The hot filling process is acceptable for commodities having a high acid content, but not generally acceptable for non-high acid content commodities. Nonetheless, manufacturers and fillers of non-high acid content commodities desire to supply their commodities in PET containers as well. For non-high acid commodities, pasteurization and retort are the preferred sterilization processes. Pasteurization and retort both present a challenge for manufactures of PET containers in that heat-set containers cannot withstand the temperature and time demands required of pasteurization and retort.

Pasteurization and retort are both processes for cooking or sterilizing the contents of a container after filling. Both processes include the heating of the contents of the container to a specified temperature, usually above approximately 70° C. (approximately 155° F.), for a specified length of time (20-60 minutes). Retort differs from pasteurization in that retort uses higher temperatures to sterilize the container and cook its contents. Retort also applies elevated air pressure externally to the container to counteract pressure inside the container. The pressure applied externally to the container is necessary because a hot water bath is often used and the overpressure keeps the water, as well as the liquid in the contents of the container, in liquid form, above their respective boiling point temperatures.

PET is a crystallizable polymer, meaning that it is available in an amorphous form or a semi-crystalline form. The ability of a PET container to maintain its material integrity relates to the percentage of the PET container in crystalline form, also known as the "crystallinity" of the PET container. The following equation defines the percentage of crystallinity as a volume fraction:

$$\%\ \text{Crystallinity} = \frac{\rho - \rho_a}{\rho_c - \rho_a} \times 100$$

where ρ is the density of the PET material; $\rho_\alpha$ is the density of pure amorphous PET material (1.333 g/cc); and $\rho_c$ is the density of pure crystalline material (1.455 g/cc).

Container manufactures use mechanical processing and thermal processing to increase the PET polymer crystallinity of a container. Mechanical processing involves orienting the amorphous material to achieve strain hardening. This processing commonly involves stretching a PET preform along a longitudinal axis and expanding the PET preform along a transverse or radial axis to form a PET container. The combination promotes what manufacturers define as biaxial orientation of the molecular structure in the container. Manufacturers of PET containers currently use mechanical processing to produce PET containers having approximately 20% crystallinity in the container's sidewall.

Thermal processing involves heating the material (either amorphous or semi-crystalline) to promote crystal growth. On amorphous material, thermal processing of PET material results in a spherulitic morphology that interferes with the transmission of light. In other words, the resulting crystalline material is opaque, and thus, generally undesirable. Used after mechanical processing, however, thermal processing results in higher crystallinity and excellent clarity for those portions of the container having biaxial molecular orientation. The thermal processing of an oriented PET container, which is known as heat setting, typically includes blow molding a PET preform against a mold heated to a temperature of approximately 120° C.-130° C. (approximately 248° F.-266° F.), and holding the blown container against the heated mold for approximately three (3) seconds. Manufacturers of PET juice bottles, which must be hot-filled at approximately 85° C. (185° F.), currently use heat setting to produce PET bottles having an overall crystallinity in the range of approximately 25%-35%.

After being hot-filled, the heat-set containers are capped and allowed to reside at generally the filling temperature for approximately five (5) minutes at which point the container, along with the product, is then actively cooled prior to transferring to labeling, packaging, and shipping operations. The cooling reduces the volume of the liquid in the container. This product shrinkage phenomenon results in the creation of a vacuum within the container. Generally, vacuum pressures within the container range from 1-300 mm Hg less than atmospheric pressure (i.e., 759 mm Hg-460 mm Hg). If not controlled or otherwise accommodated, these vacuum pressures result in deformation of the container, which leads to either an aesthetically unacceptable container or one that is unstable.

In many instances, container weight is correlated to the amount of the final vacuum present in the container after this fill, cap and cool down procedure, that is, the container is made relatively heavy to accommodate vacuum related forces. Similarly, reducing container weight, i.e., "lightweighting" the container, while providing a significant cost savings from a material standpoint, requires a reduction in the amount of the final vacuum. Typically, the amount of the final vacuum can be reduced through various processing options such as the use of nitrogen dosing technology, minimize headspace or reduce fill temperature. One drawback with the use of nitrogen dosing technology however is that the maximum line speeds achievable with the current technology is limited to roughly 200 containers per minute. Such slower line speeds are seldom acceptable. Additionally, the dosing consistency is not yet at a technological level to achieve efficient operations. Minimizing headspace requires more precession during filling, again resulting in slower line speeds. Reducing fill temperature is equally disadvantageous as it limits the type of commodity suitable for the container.

Typically, container manufacturers accommodate vacuum pressures by incorporating structures in the container sidewall. Container manufacturers commonly refer to these structures as vacuum panels. Traditionally, these paneled areas have been semi-rigid by design, unable to accommodate the high levels of vacuum pressures currently generated, particularly in lightweight containers. In some applications, these paneled areas may not be aesthetically pleasing.

Development of technology options to achieve an ideal balance of light-weighting and design flexibility are of particular interest. According to the principles of the present teachings, an alternative vacuum absorbing capability is provided within the container base. Traditional hot-fill containers accommodate nearly all vacuum forces within the body (or sidewall) of the container through deflection of the vacuum panels. These containers are typically provided with a rigid base structure that substantially prevents deflection thereof and thus tends to be heavier than the rest of the container. In contrast, Applicants utilize a lightweight base designed to accommodate nearly all vacuum forces.

Therefore, an object of the present teachings is to achieve the optimal balance of weight and vacuum performance of both the container body and base. To achieve this, in some embodiments, a hot-fill container is provided that comprises a lightweight, flexible base design that is easily moveable to accommodate vacuum, but does not require a dramatic inversion or snap-through, thus eliminating the need for a heavy sidewall or vacuum panels. Utilizing a lightweight base design to absorb vacuum forces enables an overall light-weighting, design flexibility, and permits use of a smooth, "glass-like," aesthetically pleasing sidewall, which need not include vacuum panels.

SUMMARY

This section provides a general summary of the disclosure, and is not a comprehensive disclosure of its full scope or all of its features.

The present teachings provide for a container including a finish, a shoulder portion, a sidewall, and a base portion. The finish defines an opening. The shoulder portion extends from the finish. The sidewall extends from the shoulder portion and defines a volume of the container. The base portion is at an end of the sidewall opposite to the shoulder portion. The base portion includes a primary standing ring and a secondary standing ring. The base portion is movable from an as-blown position to an expanded position and from the expanded position to a retracted position. In the as-blown and retracted positions the primary standing ring is configured to support the container upright. In the expanded position the secondary standing ring is configured to support the container upright.

The present teachings further provide for a container including a finish, a shoulder portion, a sidewall, and a base portion. The finish defines an opening. The shoulder portion extends from the finish. The sidewall extends from the shoulder portion and defines a volume of the container. The base portion is at an end of the sidewall opposite to the shoulder portion. The base portion is movable from an as-blown position to an expanded position, and from the expanded position to a retracted position. The base portion includes: a primary standing ring, a central zone, and a secondary standing ring between the primary standing ring and the central zone. The central zone is configured to move along a longitudinal axis of the container without flexing as the base portion moves from the as-blown position to the expanded position, and from the expanded position to the retracted position. In the as-blown and the retracted positions the primary standing ring is configured to support the container upright. In the expanded position the secondary standing ring extends out from within the container and beyond the primary standing ring in order to support the container upright.

The present teachings also provide for a container including a finish, a shoulder portion, a sidewall, a base portion, and a closure. The finish defines an opening. The shoulder portion extends from the finish. The sidewall extends from the shoulder portion and defines a volume of the container. The base portion is at an end of the sidewall opposite to the shoulder portion. The base portion is movable from an as-blown position to an expanded position, and from the expanded position to a retracted position. The base portion includes a primary standing ring, a central zone, and a secondary standing ring between the primary standing ring and the central zone. The closure is configured to couple with the finish to seal the container closed. The closure may include a vacuum seal indicator. The central zone is configured to move along a longitudinal axis of the container as the base portion moves from the as-blown position to the expanded position, and from the expanded position to the retracted position. In the as-blown and the retracted positions the primary standing ring is configured to support the container upright. In the expanded position the secondary standing ring extends out from within the container and beyond the primary standing ring in order to support the container upright.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
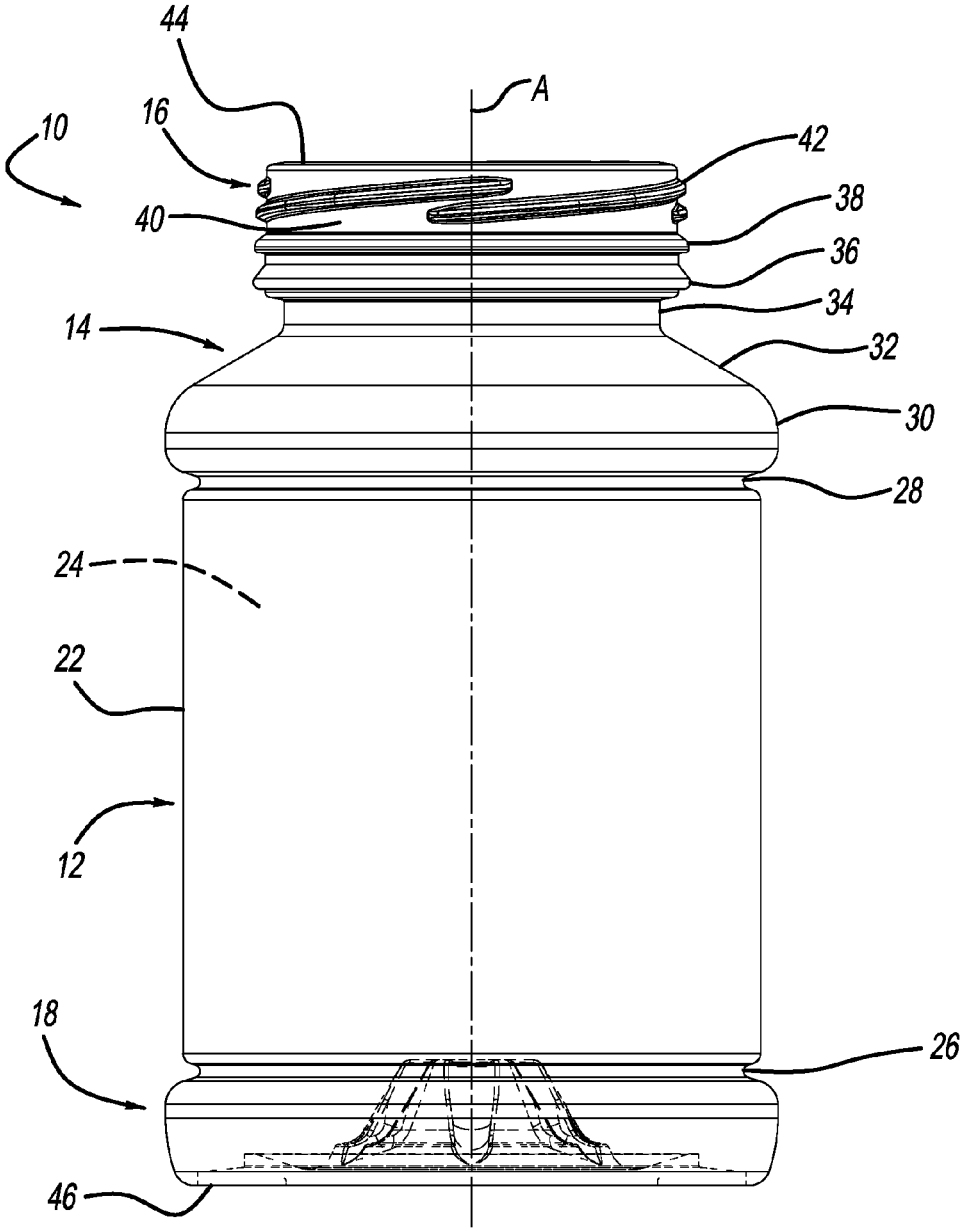
FIG. 1 is a side view of a container according to the present teachings.

With initial reference to FIG. 1, a container according to the present teachings is generally illustrated at reference numeral 10. The container 10 generally includes a body portion 12, a shoulder portion 14, a finish 16, and a base portion 18.

The body portion 12 includes a sidewall 22, which is cylindrical or generally cylindrical, and defines a volume 24 of the container 10. The sidewall 22 is generally smooth and without vacuum panels, which advantageously provides the container 10 with a "glass-like" appearance. Between the body portion 12 and the base portion 18 is a first recessed ring 26. Between the body portion 12 and the shoulder portion 14 is a second recessed ring 28.

The shoulder portion 14 extends from the second recessed ring 28 towards the finish 16. The shoulder portion 14 includes an outer diameter portion 30, and a tapered surface 32. The tapered surface 32 extends from the outer diameter portion 30 towards the finish 16, and is tapered such that the tapered surface 32 has a progressively smaller diameter as it extends away from the outer diameter portion 30. The tapered surface 32 extends from the outer diameter portion to neck 34.

The finish 16 extends from the neck 34 and includes a first annular rib 36 and a second annular rib 38. The first annular rib 36 is between the second annular rib 38 and the neck 34. Each of the first annular rib 36 and the second annular rib 38 extend outward beyond an annular sidewall 40 of the finish 16.

Extending outward from the annular sidewall 40 are threads 42. The threads 42 are configured to cooperate with any suitable closure in order to close the container 10 by covering an opening defined by the finish 16, which leads to the volume 24. The annular sidewall 40 extends to an upper end 44 of the container 10 at which the opening is defined. The upper end 44 is opposite to a base end 46 of the container 10 at the base portion 18. The finish 16 can be any suitable finish, such as a wide-mouth blow trim finish of any suitable size, such as about 43 mm or greater, or an injected finish of about 43 mm or smaller, for example.

The container 10 can be any suitable container, such as a blow-molded, biaxially oriented container with a unitary construction made from a single- or multi-layer material. An exemplary stretch-molding, heat-setting process for making the container 10 generally includes manufacture of a preform (not illustrated) of a suitable polyester material, such as a polyethylene terephalate (PET), having a shape known to those skilled in the art as being similar to a test-tube with a generally cylindrical cross-section and a length typically about fifty percent (50%) that of a height of the container 10.

A machine (not illustrated) places the preform heated to a temperature between approximately 190° F. to 250° F. (approximately 88° C. to 121° C.) into a mold cavity having a shape similar to that of the container 10. The mold cavity is heated to a temperature between approximately 250° F. to 350° F. (approximately 121° C. to 177° C.). A stretch rod apparatus (not illustrated) stretches or extends the heated preform within the mold cavity to a length approximately that of the container 10 thereby molecularly orienting the polyester material in an axial direction generally corresponding with the longitudinal axis A of the container 10. When the stretch rod extends the preform, air with a pressure between 300 PSI to 600 PSI (2.07 MPa to 4.14 MPa) assists in extending the preform in the axial direction and expanding the preform in a circumferential or hoop direction thereby substantially conforming the polyester material to the shape of the mold cavity and further molecularly orienting the polyester material in a direction generally perpendicular to the axial direction, thus establishing the biaxial molecular orientation of the polyester material in most of the container.

Typically, material with the finish 16 and a sub-portion of the base portion 18 are not substantially molecularly oriented. The pressurized air holds the mostly biaxial molecularly oriented polyester material against the mold cavity for a period of approximately two to five seconds before removal of the container from the mold cavity. To achieve appropriate material distribution within the base portion 18, an additional stretch-molding step substantially as taught by U.S. Pat. No. 6,277,321, which is incorporated herein by reference, may be used. Alternatively, other manufacturing methods using other conventional thermoplastic materials including, for example, high density polyethylene, polypropylene, polyethylene naphthalate (PEN), a PET/PEN blend or copolymer, and various multi-layer structures may be used to manufacture the container 10.

For hot-fill bottling applications, bottlers generally fill the container 10 with a liquid or product at an elevated temperature between approximately 195° F. to 205° F. (approximately 90.5° C. to 96° C.) and seal the container 10 with a closure before cooling. As the sealed container 10 cools, a vacuum, or negative pressure, forms inside causing the container 10 to change shape, particularly the base portion 18 as described herein. In addition, the container 10 may be suitable for other high-temperature pasteurization or retort filling processes, or other thermal processes as well.

Figure 3:
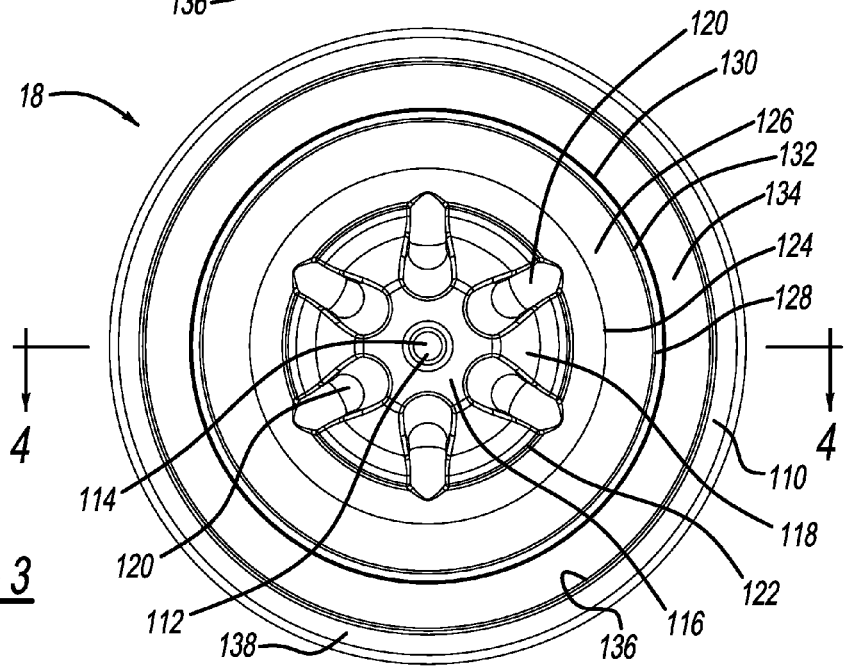
FIG. 3 is a bottom view of the base portion of the container of FIG. 1.
Figure 4:
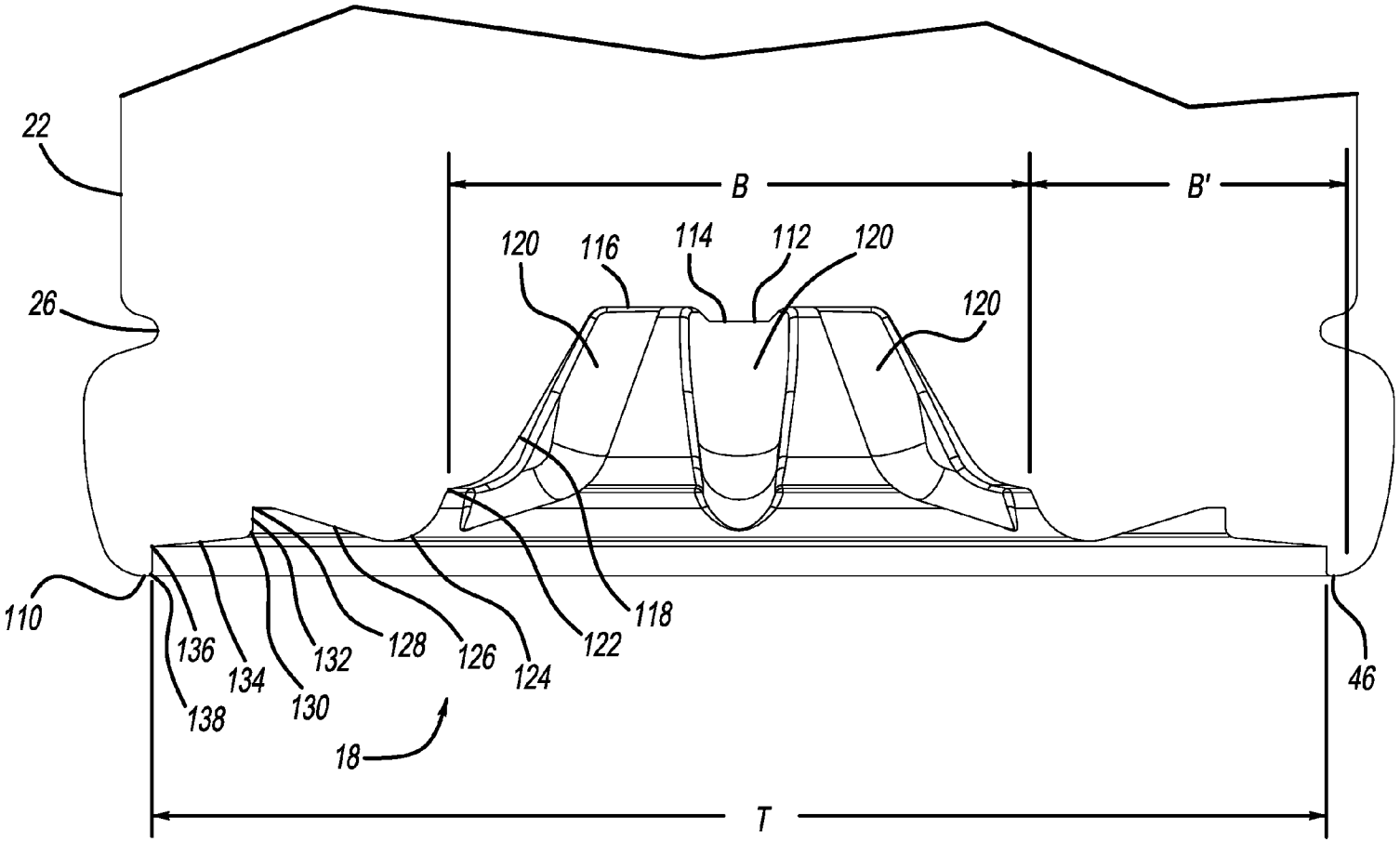
FIG. 4 is a cross-sectional view taken along line 4-4 of FIG. 3.
Figure 5:
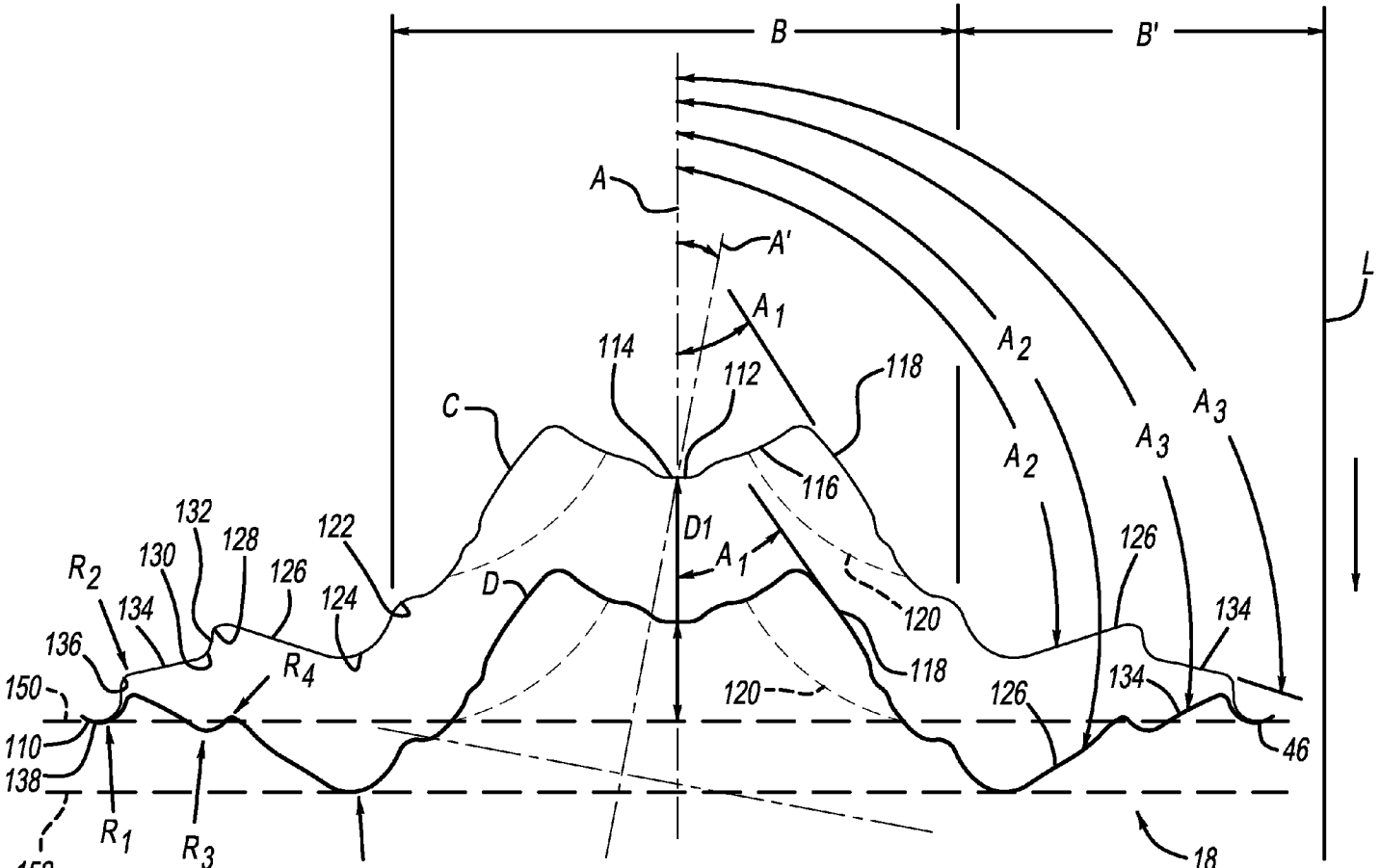
FIG. 5 illustrates movement of the base portion of the container of FIG. 1 from an as-blown position to an extended position.

With continued reference to FIG. 1, and additional reference to FIGS. 2-5, the base portion 18 will now be described in detail, as well as movement of the base portion 18 in response to temperatures and pressures experienced by the container 10 during hot-filling of the container 10. FIGS. 1-4 illustrate the base portion 18 in an "as-blown" configuration approximately 72 hours after having been formed, and having been stored at normal conditions. FIG. 5 illustrates the as-blown orientation of the base portion 18 at C. FIG. 5 also illustrates the base portion 18 in an extended position and orientation at D, which is described in further detail herein.

The base portion 18 generally includes a primary standing ring 110 at an outer diameter thereof. At an axial center 112 of the base portion 18 is a gate area 114, which is generally circular. The longitudinal axis A of the container 10 extends through the axial center 112. Extending from the axial center 112 and the gate area 114 is a center surface 116. From the gate area 114, the center surface 116 can extend inward in the direction of the body portion 12 and thus away from the base end 46, as illustrated in FIG. 5.

Figure 2:
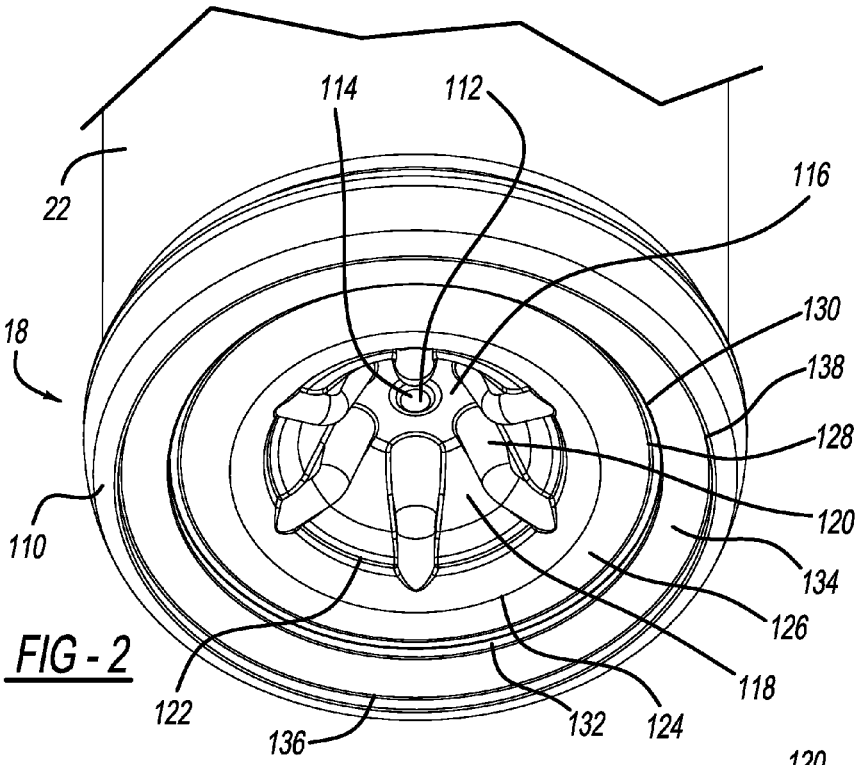
FIG. 2 is a perspective view of a base portion of the container of FIG. 1.

A side surface 118 extends from the center surface 116 towards the base end 46. The side surface 118 is angled such that it slopes away from the longitudinal axis A as the side surface 118 extends in the direction of the base end 46. As illustrated in FIGS. 2-4, the side surface 118 includes ribbed portions 120, which are recessed within the side surface 118.

The side surface 118 extends from the center surface 116 to generally an inwardly extending portion 122. With respect to an outer side of the base portion 18, the inwardly extending portion 122 is generally concave. The center surface 116, the side surface 118, and the inwardly extending portion 122 (or at least a portion of the inwardly extending portion 122) generally define a central zone B of the base portion 18, as illustrated in FIGS. 4 and 5. The central zone B has a planar area that is about 18% to about 28% of a total planar area of the base portion 18 as measured across the standing ring 110 along line T, which extends through the longitudinal axis A. For example, the central zone B can have a planar area that is about 23% of the total planar area of the base portion 18 as measured across the standing ring 110 along line T.

Surrounding the central zone B is an outer zone B' of the base portion 18. The outer zone B' includes a convex portion 124 extending from the inwardly extending portion 122. The convex portion 124 is convex with respect to an outer surface of the base portion 18. The convex portion 124 provides a secondary standing ring/surface, as further described herein. In some instances, the convex portion 124 is thus also referred to herein as secondary standing ring/surface 124.

A generally planar portion 126 extends from the convex portion 124. From the convex portion 124 the generally planar portion 126 extends to a concave portion 128, which is concave with respect to an outer surface of the base portion 18. A convex portion 130, which is convex with respect to an outer surface of the base portion 18, is spaced apart from the concave portion 128, and is connected thereto with a generally planar portion 132.

Extending from the convex portion 130 away from the longitudinal axis A is another planar portion 134. The planar portion 134 extends away from the longitudinal axis A to a concave portion 136, which is generally concave with respect to an outer surface of the base portion 18. Extending from the concave portion 136 is a convex portion 138, which is generally convex with respect to an outer surface of the base portion 18, and includes the primary standing ring 110.

Figure 7:
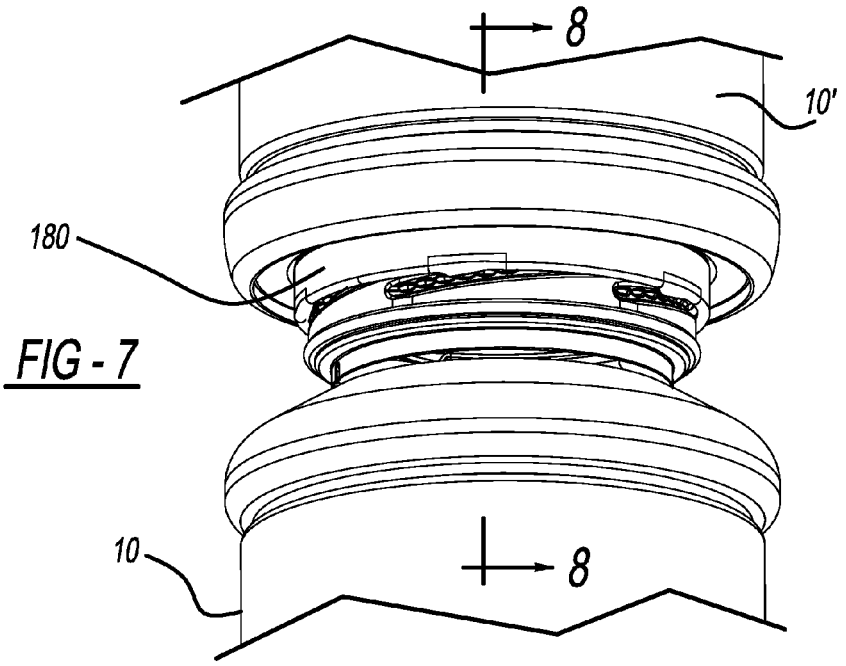
FIG. 7 is a perspective view illustrating the container of FIG. 1 with another container stacked thereon, the container of FIG. 1 has a modified finish and includes a closure.
Figure 8:
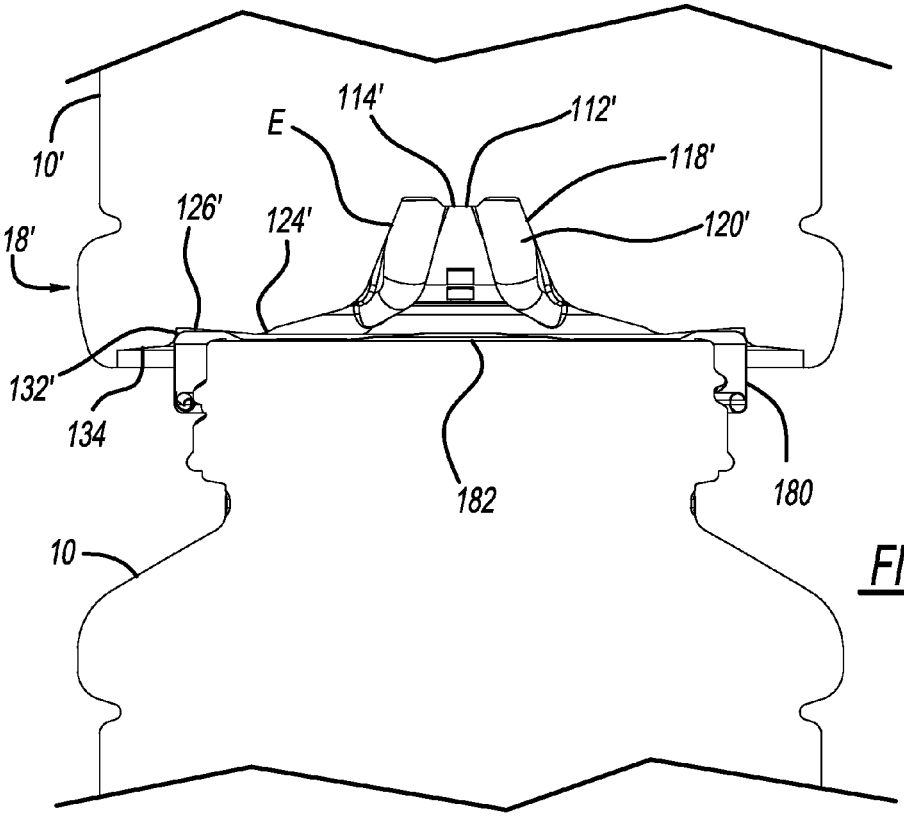
FIG. 8 is a cross-sectional view taken along line 8-8 of FIG. 7.

With particular reference to FIG. 5, the primary standing ring 110 is configured to support the container 10 upright on a first standing surface 150 when the base portion 18 is in the as-blown configuration C of FIG. 5, which is before the container 10 is filled, such as by hot-filling. When the container 10 is hot-filled, product heated to 195-205° F. (90.5-96° C.) is loaded into the container 10, and then the finish 16 is quickly capped with a suitable closure, such as the closure 180 of FIGS. 7 and 8. Although the closure 180 is illustrated as a metal lug closure (and the finish 16 of FIGS. 7 and 8 is modified to have internal threads 42), the closure 180 can be any suitable closure, such as a threaded plastic closure or a combi closure.

In response to receipt of the heated product and an increased pressure resulting from closing the container 10 with the closure 180, the base portion 18 moves outward along the longitudinal axis A to the extended position D of FIG. 5. The central zone B does not flex as it moves along the longitudinal axis A to the extended position D. In contrast, portions of the base portion 18 in the outer zone B' do flex. For example, the secondary standing ring 124 flexes outward beyond the primary standing ring 110 and the first standing surface 150. The secondary standing ring 124 is configured to support the container 10 upright on a second standing surface 152 when the base portion 18 moves to the extended position D. When transitioning from the as-blown position C to the extended position D and the retracted position E1-E2 (described herein), any tilting experienced by the container 10, such as at the base portion 18, will typically be less than about 2° (such as less than about 0.5°) as measured between longitudinal axis A and axis A' of FIG. 5.

As the base portion 18 moves from the as-blown position C to the extended position D, the side surface 118 of the central zone B does not flex, but merely moves in a direction generally parallel to the longitudinal axis A. Therefore, angle $A_1$ of the side surface 118 relative to the longitudinal axis A remains constant as the base portion 18 moves from the as-blown position C to the extended position D. In contrast, angle $A_2$ of planar portion 126 relative to the longitudinal axis A, and angle $A_3$ of planar surface 134 relative to the longitudinal axis A, both decrease as the base portion 18 moves from the as-blown position C to the extended position D. Central zone B includes the ribbed portions 120, which act as strengthening ribs to enhance the rigidity of the central zone B.

As the base portion 18 moves from the as-blown position C to the extended position D, various bend radii of the outer zone B' change in response to flexing of the outer zone B' generally outward. As illustrated in FIG. 5, bend radii $R_1$-$R_5$ change as follows: $R_1$ increases ($R_1$ is generally at the primary standing ring 110); $R_2$ decreases ($R_2$ is generally at the concave portion 136); $R_3$ increases ($R_3$ is generally at the convex portion 130); $R_4$ increases ($R_4$ is generally at the concave portion 128); and $R_5$ decreases to provide the secondary standing ring ($R_5$ is generally at the convex portion 124). As the central zone B moves from the as-blown position C to the extended position D, distance $D_1$ measured from the gate area 114 to the first standing surface 150 decreases.

Movement of the base portion 18 from the as-blown position C to the extended position D in response to increased pressure can be summarized as follows:

| | |
|---|---|
| $R_1$ | Increase |
| $R_2$ | Decrease |
| $R_3$ | Increase |
| $R_4$ | Increase |
| $R_5$ | Decrease |
| $A_1$ | Constant/Generally Constant |
| $A_2$ | Decrease |
| $A_3$ | Decrease |
| $D_1$ | Decrease |

Exemplary dimensions of the base portion 18 in the as-blown position C as compared to the extended position D are set forth below:

| Feature | Exemplary As-Blown Position C | Exemplary Extended Position D | Change |
|---|---|---|---|
| $R_3$ | 0.097 mm | 0.11 mm | +0.013 mm |
| $R_5$ | 0.156 mm | 0.139 mm | −0.017 mm |
| $A_1$ | 37° | 37° | 0° |

-continued

| Feature | Exemplary As-Blown Position C | Exemplary Extended Position D | Change |
|---|---|---|---|
| $A_2$ | 74° | 57° | −17° |
| $A_3$ | 101° | 63° | −38° |
| $D_1$ | 0.6 mm | 0.25 mm | −0.35 mm |

As the hot-filled product cools, temperature of the base portion 18 decreases, and an internal vacuum is created within the container. As a result, the base portion 18 moves from the extended position D to retracted position E1-E2, which includes position E1, E2, or any position between E1 and E2 illustrated in FIG. 6. For reference purposes, FIG. 6 also illustrates the as-blown position C. The base portion 18 may move, for example, to position E1, which is beneath position C, to position E2, which is above and beyond position C, or to any point therebetween.

As the base portion 18 moves from the extended position D to the retracted position E1-E2, the central zone B moves along the longitudinal axis A in the direction of the finish 16, but does not substantially flex. Central zone B includes the ribbed portions 120, which act as strengthening ribs to enhance the rigidity of the central zone B.

Most of the flexing of the base portion 18 occurs at the outer zone B'. Therefore, angle $A_1$ remains constant, or generally constant, as the base portion 18 moves to the retracted position E1-E2. Angles $A_2$ and $A_3$ increase, however, as the base portion 18 moves to the retracted position E1-E2. As explained above, in the retracted position E1-E2 the base portion 18 can be at E1, E2, or at any point therebetween. Thus for ease of reference in FIG. 6, angles A1, A2, and A3 are each measured relative to illustrated position C, which is generally between E1 and E2.

With respect to the bend radii $R_1$-$R_5$, they change as follows, which is generally opposite to the change that occurs during movement of the base portion 18 from the as-blown position C to the extended position D described above: $R_1$ decreases; $R_2$ increases; $R_3$ decreases; $R_4$ decreases; and $R_5$ increases. The distance that the gate area 114 is from the first standing surface 150 increases from $D_1$ in the as-blown position C to $D_2$ in the retracted position E1-E2. In the retracted position E1-E2, the base portion 18 extends an additional four millimeters, for example, into the container 10 as compared to the as-blown position C.

Figure 6:
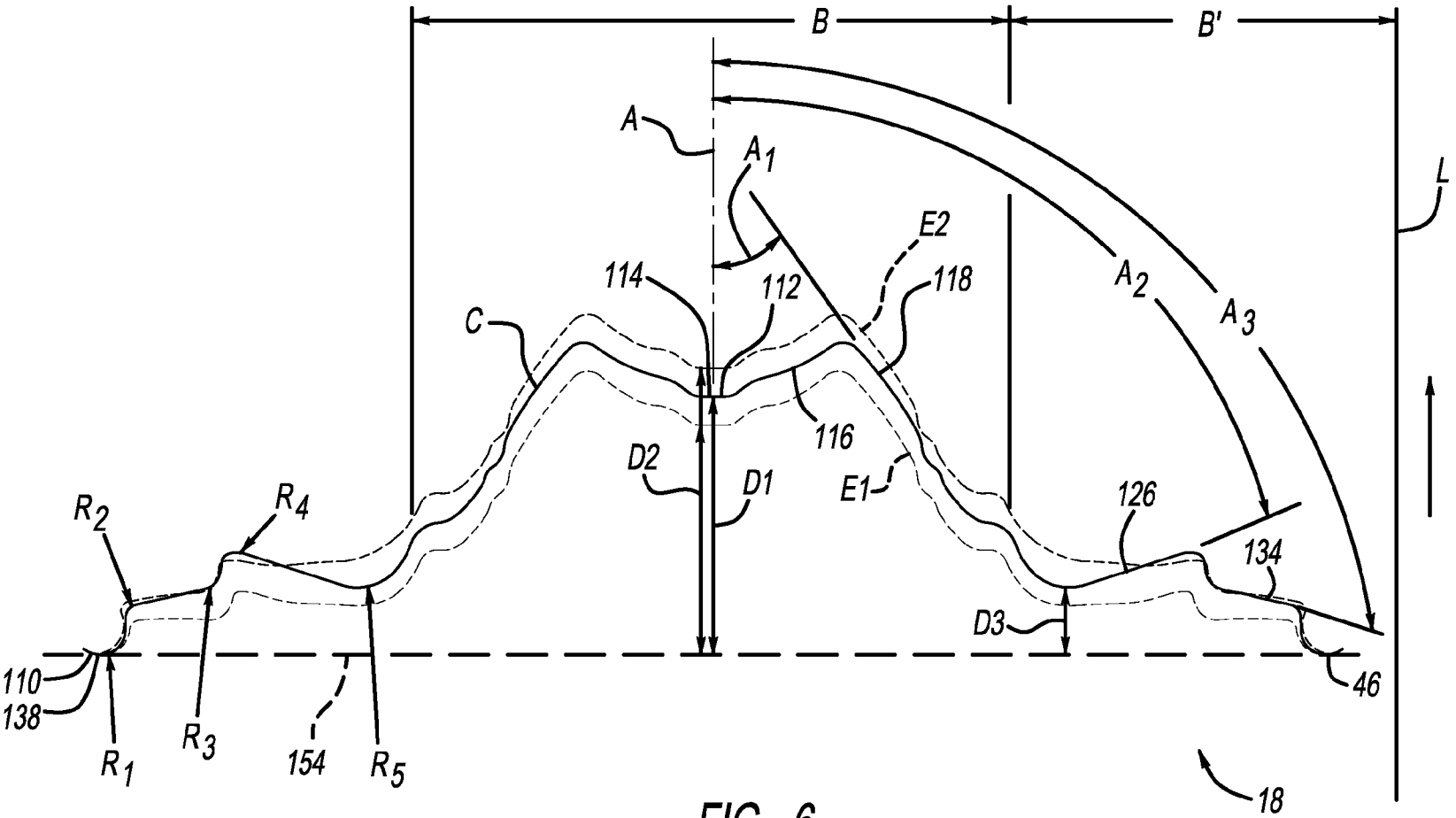
FIG. 6 illustrates the base portion of the container of FIG. 1 in the as-blown position C, in a retracted position the base portion is at E1, E2, or at any point therebetween.

The primary standing ring 110 also moves slightly inward in the direction of the finish 16 to provide a third and final standing surface 154 for the container 10. In general and as illustrated in FIG. 6, in the retracted position E1-E2 the base portion 18 is recessed within the container 10 so that $D_3$, measured between the standing surface 154 and about $R_5$ is greater than 0, and thus $R_5$ is above 154. Movement of the base portion 18 from the extended position D to the retracted position E1-E2 due to vacuum response forces can be summarized as follows:

| | |
|---|---|
| $R_1$ | Decrease |
| $R_2$ | Increase |
| $R_3$ | Decrease |
| $R_4$ | Decrease |
| $R_5$ | Increase |
| $A_1$ | Constant/Generally Constant |
| $A_2$ | Increase |
| $A_3$ | Increase |
| $D_1$ | Increase |

Exemplary dimensions of the base portion 18 in the as-blown position C as compared to the retracted position E1-E2 are set forth below:

| Feature | Exemplary as-Blown Position C | Exemplary Retracted Position E1-E2 | Change |
|---|---|---|---|
| $R_3$ | 0.097 mm | 0.069 mm | −0.028 |
| $R_5$ | 0.156 mm | 0.192 mm | +0.036 |
| $A_1$ | 37° | 37° | 0° |
| $A_2$ | 74° | 76° | +2° |
| $A_3$ | 101° | 106° | +5° |
| $D_1$ | 0.6 mm | 0.6 mm | 0 |

Exemplary differences between the pressure response of extended position D and the vacuum response of the retracted position E1-E2 are set forth below:

| Feature | Exemplary Pressure Response | Exemplary Vacuum Response | Change | Result |
|---|---|---|---|---|
| $R_3$ | 0.11 mm | 0.069 mm | −0.041 | Decrease |
| $R_5$ | 0.139 mm | 0.192 mm | +0.053 | Increase |
| $A_1$ | 37° | 37° | 0° | Equal |
| $A_2$ | 57° | 76° | 19° | Increase |
| $A_3$ | 63° | 106° | 43° | Increase |
| $D_1$ | 0.25 mm | 0.6 mm | 0.35 mm | Increase |

Movement of the base portion 18 from the as-blown position C to the extended position D, and to the retracted position E1-E2 allows the container 10 to respond to the increased temperatures and pressures associated with, for example, hot fill applications, without having to include vacuum absorption features in the sidewall 22. As a result, the sidewall 22 can have a generally smooth and "glass-like" appearance, as illustrated in FIG. 1, for example. Further, no base over-stroke operation is required with the container 10. When transitioning from the as-blown position to the extended position and retracted position, any tilting experienced by the container 10 is less than about 2 degrees, such as less than about 0.5 degrees measured between the longitudinal axis A and A'.

At room temperature, there are between five and 15 inches Hg of residual vacuum in the filled and cooled container. This remaining vacuum is useful when the closure 180 is a metal lug style closure, as illustrated in FIGS. 7 and 8. For example, the closure 180 can include a freshness indicator/tamper evident button 182 at a center thereof (FIG. 8). The button 182 is drawn inward when the container is unopened in response to vacuum pressures therein. When the container 10 is opened, the button 182 pops out, typically with an audible sound, which indicates to a consumer that the product inside the container 10 is fresh. Geometry of the base portion 18 can be optimized to work together with the closure 180 and the button 182 thereof in order to ensure that a proper amount of residual vacuum is present within the container 10 for the button 182 to operate properly.

With reference to FIGS. 7 and 8, the container 10 is illustrated with a second container 10' stacked thereon. The container 10' is similar to the container 10, and thus features of the container 10' that are in common with the container 10 are illustrated with the same reference numerals, but include the prime (') symbol. In the retracted position E1-E2, the base portion 18' of the container 10' provides a stacking surface. Specifically, the generally planar portion 126' of the container 10' provides a standing surface for container 10' atop the closure 180 of the container 10. The closure 180 of container 10 can be received within the base portion 18' such that generally planar portion 132' of the container 10', which is generally vertical in the retracted position E1-E2 of FIG. 8, surrounds the closure 180 in order to securely receive the closure 180 within the base portion 18' and prevent the container 10' from sliding off of the closure 180.

Figure 9:
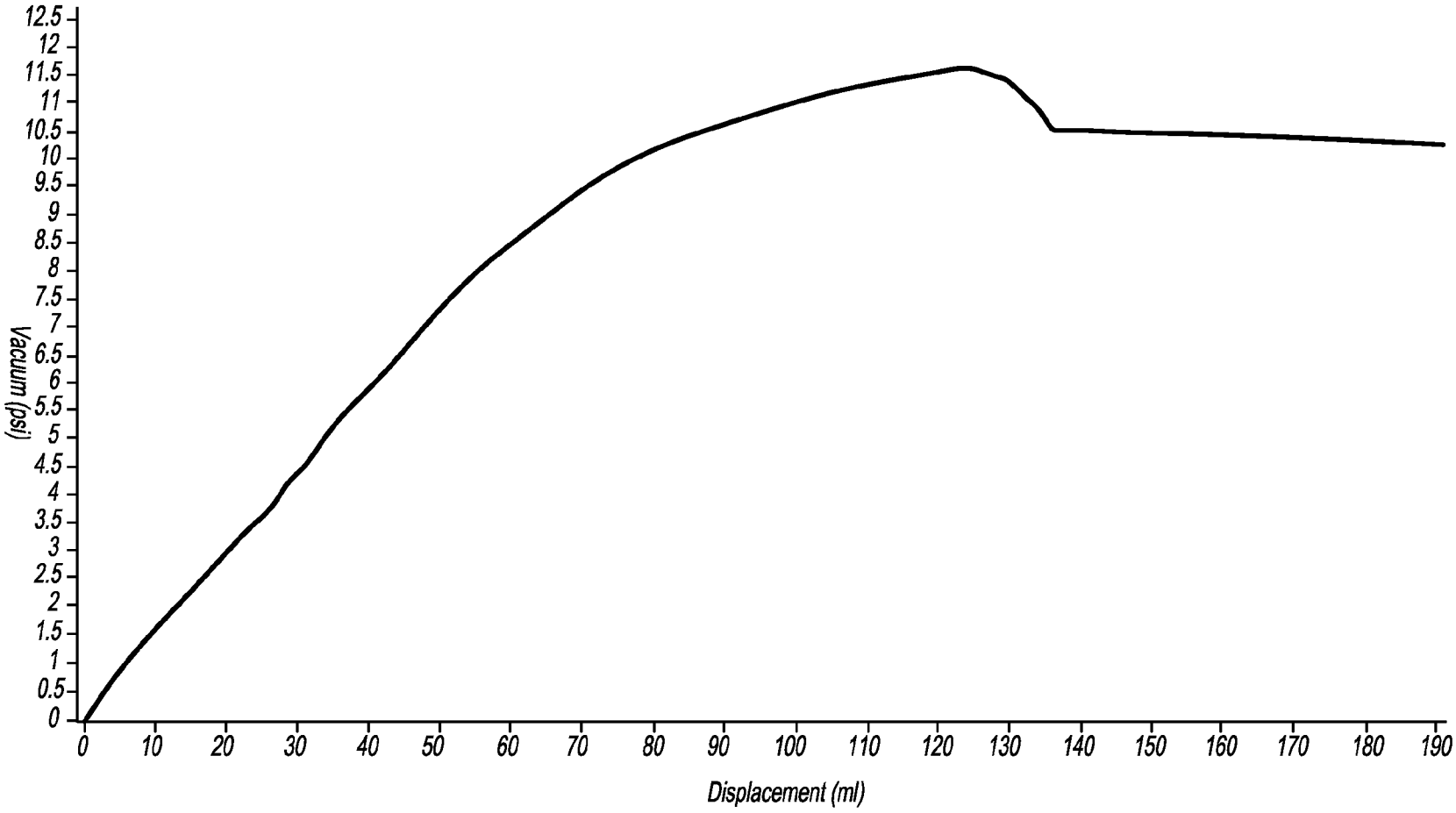
FIG. 9 is a graph illustrating displacement of the base portion of the container of FIG. 1 versus vacuum pressure.
Figure 10:
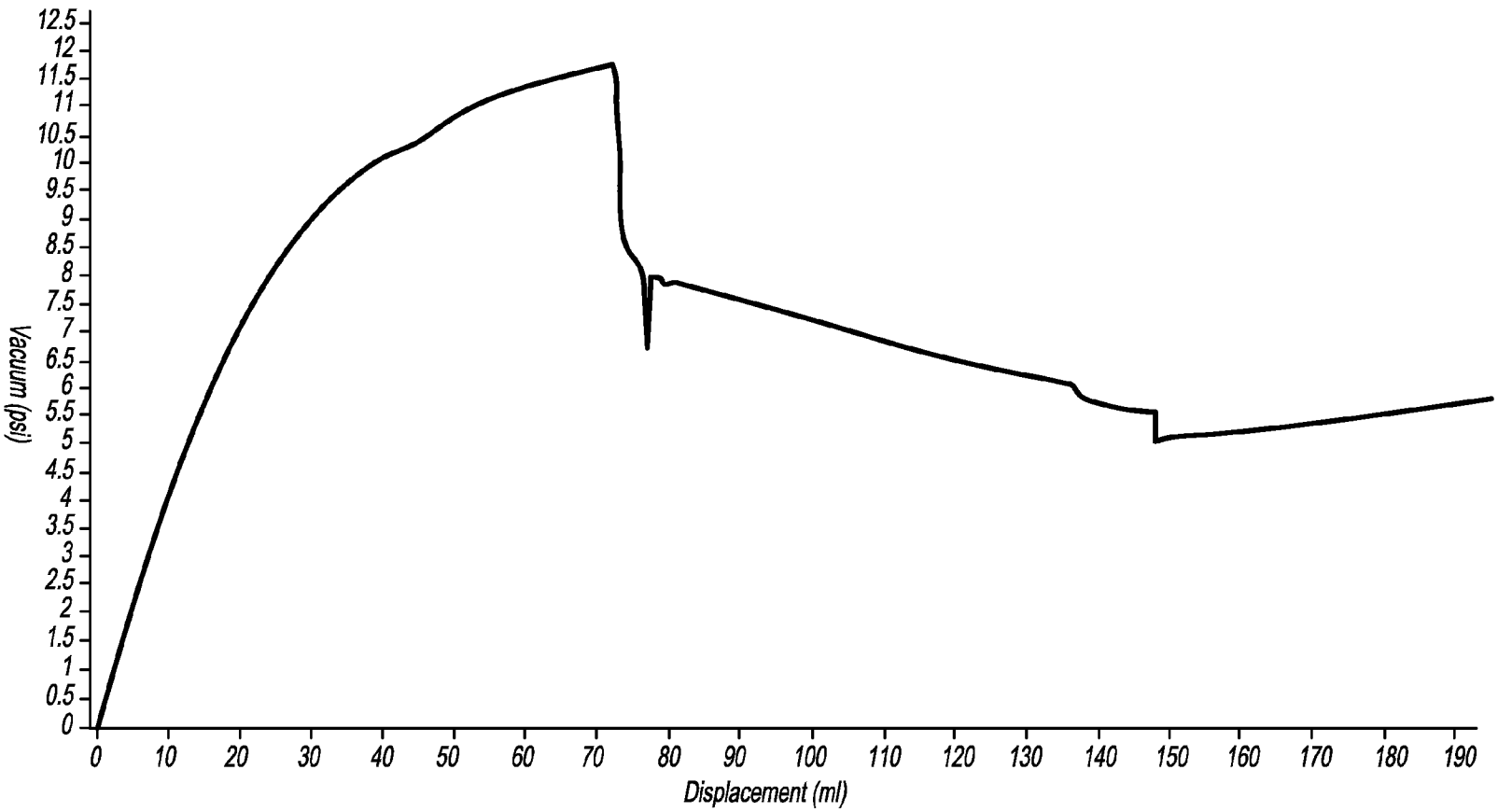
FIG - 10 Prior Art
FIG. 10 is a graph illustrating displacement of the base portion of a prior art container versus vacuum pressure.

FIG. 9 is a graph of performance of an exemplary container 10 including base portion 18 according to the present teachings showing displacement of the sidewall 22 at various vacuum pressures. FIG. 9 is a similar graph of a prior art container. As illustrated in FIG. 9, the prior art container experiences failure or an undesirable response at a sidewall thereof at about only 11.32 PSI and after about 72 ml of displacement. In contrast, the container 10 of the present teachings experiences reduced sidewall performance at about 11.55 PSI and after about 125 ml of displacement.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A container comprising:

a finish defining an opening;

a shoulder portion extending from the finish;

a sidewall extending from the shoulder portion and defining a volume of the container; and a base portion at an end of the sidewall opposite to the shoulder portion and including a primary standing ring and a secondary standing ring, the base portion movable from an as-blown position to an expanded position and from the expanded position to a retracted position;

wherein:

in the as-blown and retracted positions the primary standing ring is configured to support the container upright; and in the expanded position the secondary standing ring is configured to support the container upright.

2. The container of claim 1, wherein in the as-blown position the secondary standing ring is recessed within the container.

3. The container of claim 1, wherein in the expanded position, the secondary standing ring protrudes outward beyond the primary standing ring and a base end of the container.

4. The container of claim 2, wherein in the retracted position the secondary standing ring is closer to the finish than the primary standing ring is.

5. The container of claim 2, wherein the secondary standing ring is in substantially the same position in both the retracted position and the as-blown position.

6. The container of claim 2, wherein the secondary standing ring is one of closer to or further from the finish in the retracted position than when in the as-blown position.

7. The container of claim 1, wherein the base portion includes a central zone through which a longitudinal axis of the container extends, the central zone has a planar area that is about 18% to about 28% of a total planar area of the base portion.

8. The container of claim 1, wherein the base portion includes a central zone through which a longitudinal axis of the container extends, the central zone has a planar area that is about 23% of a total planar area of the base portion.

9. The container of claim 1, wherein as the container transitions from the as-blown position to the expanded position and to the retracted position, the base portion tilts less than about 2 degrees with respect to a longitudinal axis of the container.

10. The container of claim 1, wherein as the container transitions from the as-blown position to the expanded position and to the retracted position, the base portion tilts less than about 0.5 degrees with respect to a longitudinal axis of the container.

11. The container of claim 1, wherein the secondary standing ring is between the primary standing ring and a central zone of the base portion.

12. The container of claim 11, wherein a longitudinal axis of the container extends through the central zone, the central zone configured to move along the longitudinal axis as the base portion moves from the as-blown position to the expanded position, and from the expanded position to the retracted position.

13. The container of claim 12, wherein the central zone is configured to not flex as the base portion moves from the as-blown position to the expanded position, and from the expanded position to the retracted position.

14. The container of claim 12, wherein the secondary standing ring is configured to flex as the base portion moves from the as-blown position to the expanded position, and from the expanded position to the retracted position.

15. The container of claim 12, wherein the container is a hot fill container;

wherein the base portion is configured to move from the as-blown position to the expanded position when the container is subject to increased temperature and increased pressure during hot fill; and wherein the base portion is configured to move from the expanded position to the retracted position as the hot fill contents cool and internal vacuum pressure increases.

16. The container of claim 1, wherein the sidewall is without a vacuum panel.

17. The container of claim 1, wherein the base portion defines a receptacle configured to receive therein a closure of a similar container to facilitate container stacking.

18. The container of claim 1, wherein a closure of the container includes a vacuum indicator.

19. A container comprising:

a finish defining an opening;

a shoulder portion extending from the finish;

a sidewall extending from the shoulder portion and defining a volume of the container; and a base portion at an end of the sidewall opposite to the shoulder portion, the base portion movable from an as-blown position to an expanded position, and from the expanded position to a retracted position, the base portion including: a primary standing ring, a central zone, and a secondary standing ring between the primary standing ring and the central zone;

wherein:

the central zone is configured to move along a longitudinal axis of the container without flexing as the base portion moves from the as-blown position to the expanded position, and from the expanded position to the retracted position;

in the as-blown and the retracted positions the primary standing ring is configured to support the container upright; and in the expanded position the secondary standing ring extends out from within the container and beyond the primary standing ring in order to support the container upright.

20. The container of claim 19, wherein the central zone includes a side surface that remains equidistant from the longitudinal axis as the central zone moves along the longitudinal axis.

21. The container of claim 19, wherein in the retracted position the secondary standing ring is recessed further within the container than when in the as-blown position.

22. The container of claim 19, wherein the sidewall is without a vacuum panel.

23. The container of claim 19, wherein the container is a hot fill container;

wherein the base portion is configured to move from the as-blown position to the expanded position when the container is subject to increased temperature and increased pressure during hot fill; and wherein the base portion is configured to move from the expanded position to the retracted position as the hot fill contents cool and internal vacuum pressure increases.

24. The container of claim 19, wherein the central zone has a planar area that is about 18% to about 28% of a total planar area of the base portion.

25. The container of claim 19, wherein the central zone has a planar area that is about 23% of a total planar area of the base portion.

26. The container of claim 19, wherein as the container transitions from the as-blown position to the expanded position and to the retracted position, the base portion tilts less than about 2 degrees with respect to the longitudinal axis of the container.

27. The container of claim 19, wherein as the container transitions from the as-blown position to the expanded position and to the retracted position, the base portion tilts less than about 0.5 degrees with respect to the longitudinal axis of the container.

28. A container comprising:

a finish defining an opening;

a shoulder portion extending from the finish;

a sidewall extending from the shoulder portion and defining a volume of the container; and a base portion at an end of the sidewall opposite to the shoulder portion, the base portion movable from an as-blown position to an expanded position, and from the expanded position to a retracted position, the base portion including: a primary standing ring, a central zone, and a secondary standing ring between the primary standing ring and the central zone;

a closure configured to couple with the finish to seal the container closed, the closure including a vacuum seal indicator;

wherein:

the central zone is configured to move along a longitudinal axis of the container as the base portion moves from the as-blown position to the expanded position, and from the expanded position to the retracted position;

in the as-blown and the retracted positions the primary standing ring is configured to support the container upright; and in the expanded position the secondary standing ring extends out from within the container and beyond the primary standing ring in order to support the container upright.

29. The container of claim 28, wherein the central zone is configured to move along the longitudinal axis of the container without flexing.

30. The container of claim 28, wherein the sidewall is entirely smooth and without a vacuum panel.

31. The container of claim 28, wherein the central zone has a planar area that is about 18% to about 28% of a total planar area of the base portion.

32. The container of claim 28, wherein the central zone has a planar area that is about 23% of a total planar area of the base portion.

33. The container of claim 28, wherein as the container transitions from the as-blown position to the expanded position and to the retracted position, the base portion tilts less than about 2 degrees with respect to the longitudinal axis of the container.

34. The container of claim 28, wherein as the container transitions from the as-blown position to the expanded position and to the retracted position, the base portion tilts less than about 0.5 degrees with respect to the longitudinal axis of the container.

* * * * *